US007794274B2

(12) United States Patent
Phillips, Jr.

(10) Patent No.: US 7,794,274 B2
(45) Date of Patent: Sep. 14, 2010

(54) RF CONNECTOR WITH INTEGRATED SHIELD

(75) Inventor: William Thomas Phillips, Jr., Boardman, OH (US)

(73) Assignee: Delphi Technologies, Inc., Troy, MI (US)

( * ) Notice: Subject to any disclaimer, the term of this patent is extended or adjusted under 35 U.S.C. 154(b) by 27 days.

(21) Appl. No.: 12/220,944

(22) Filed: Jul. 30, 2008

(65) Prior Publication Data

US 2010/0029132 A1 Feb. 4, 2010

(51) Int. Cl.
*H01R 9/05* (2006.01)

(52) U.S. Cl. ..... 439/578; 439/628; 439/675

(58) Field of Classification Search ..... 439/578, 439/580, 585, 628, 675, 607.17
See application file for complete search history.

(56) References Cited

U.S. PATENT DOCUMENTS 2,755,331 A * 7/1956 Melcher ..... 174/87
5,062,808 A * 11/1991 Hosler, Sr. ..... 439/580
5,217,391 A * 6/1993 Fisher, Jr. ..... 439/578
5,217,392 A * 6/1993 Hosler, Sr. ..... 439/585
6,264,480 B1 7/2001 Nealis et al.
6,447,323 B1 * 9/2002 Watanabe ..... 439/371
7,400,303 B1 7/2008 Miller
2006/0178047 A1 * 8/2006 Croan ..... 439/578
2008/0233796 A1 * 9/2008 Segrt ..... 439/578

* cited by examiner

*Primary Examiner*—Hien Vu
(74) *Attorney, Agent, or Firm*—Thomas N. Twomey

(57) ABSTRACT

An RF connector assembly has a first connector housing with a first end constructed for connectably receiving a terminal end for a first coaxial cable and a second connector housing with a first end constructed for connectably receiving a complementary terminal end for a second coaxial cable. The terminal end and complementary terminal end are complementarily constructed for engagement to each other. The first and second connector housing are constructed at their respective second ends to connect to one another. The first connector housing receives a tubular shield mounted about and connected to the respective terminal end. The tubular shield has a set of resilient radially inwardly extending contact fingers for electrically connecting about the complementary terminal end when the second connector housing is connected to the first connector housing.

5 Claims, 4 Drawing Sheets

RF CONNECTOR WITH INTEGRATED SHIELD

TECHNICAL FIELD

The field of this invention relates to RF connectors.

BACKGROUND OF THE INVENTION

Radio Frequency (RF) connectors most often referred to simply as RF connectors are often used to connect coaxial cable while providing a certain degree of shielding. In recent times, the use of these connectors and coaxial cable has greatly increased in automotive applications with the advent of FM/AM radio, satellite based communication systems, e.g. OnStar™, keyless vehicle entry systems, navigations systems for eg. Global positioning systems, collision avoidance systems and other communication devices.

The use of connectors for automotive usage has become so common that standards have been devised such as Fakra, and Uscar-17 specification of −45 dB. Other specifications such as low contact resistance have also been created. Some present day terminal connectors that meet these specifications are combination of plastic outer housings that snap fit together that include high cost cold drawn tubular RF terminals. Lower cost stamped RF terminals provide only partial shielding up to 2 GHz. New desired frequencies of 3 or 4 GHz create leakage issues for many terminal connectors.

Furthermore, a single automobile with many of the above features may have over forty or so RF Fakra connectors installed on the vehicle. Furthermore, many of these automotive communication devices work at higher and higher frequencies now in the 3 GHz range or above. Furthermore, present day connectors need to be properly seated to provide adequate shielding i.e. improper station causes significant RF leakage. Thus, present day RF connectors have strict manufacturing tolerances to assure proper seating which drives costs up of each connector.

What is needed is a low cost RF connector having stamped terminal connectors which meets all known specifications and has improved shielding up to frequencies above 3 GHz, and allows for greater manufacturing tolerance for the terminals and connector housings.

SUMMARY OF THE DISCLOSURE

In accordance with one aspect of the invention, an RF connector assembly has a first connector housing with a first end constructed for connectably receiving and housing a terminal end for a first coaxial cable and a second connector housing with a respective first end constructed for connectably receiving and housing a complementary second terminal end for a second coaxial cable. The first and second connector housing are also constructed at their respective second ends to connect to one another. The terminal end and complementary second terminal end are complementary constructed for engagement to each other when the connector housings are connected to each other. The first connector housing receives a tubular shield mounted about and connected to the respective terminal end. The tubular shield has a set of resilient radially inwardly extending contact fingers for connecting about the complementary second terminal end when the second connector housing is connected to the first connector housing.

Preferably, the tubular shield has a second set of resiliently radially inwardly extending contact fingers for connecting about the terminal end in the first connector housing. The first and second sets of resiliently radially inwardly extending contact fingers are axially spaced from each other in proximity to opposite ends of the tubular shield. It is desired that each set of contact fingers extend inwardly from a respective end of the shield.

The shield in one embodiment has an axially extending seam. In another embodiment, the seam is provided with overlapping tabs extending along the length of the shield. In another embodiment, the seam is provided with complementary interlocking tabs and notches to prevent the seam from opening up. In accordance with another aspect of the invention, a tubular shield for an RF terminal connector assembly has a set of resilient radially inwardly extending contact fingers at each end for connection to respective connecting ends of complementary terminals for first and second coaxial cables.

BRIEF DESCRIPTION OF THE DRAWINGS

Reference now is made to the accompanying drawings in which.

DETAILED DESCRIPTION OF THE PREFERRED EMBODIMENT

Figure 1:
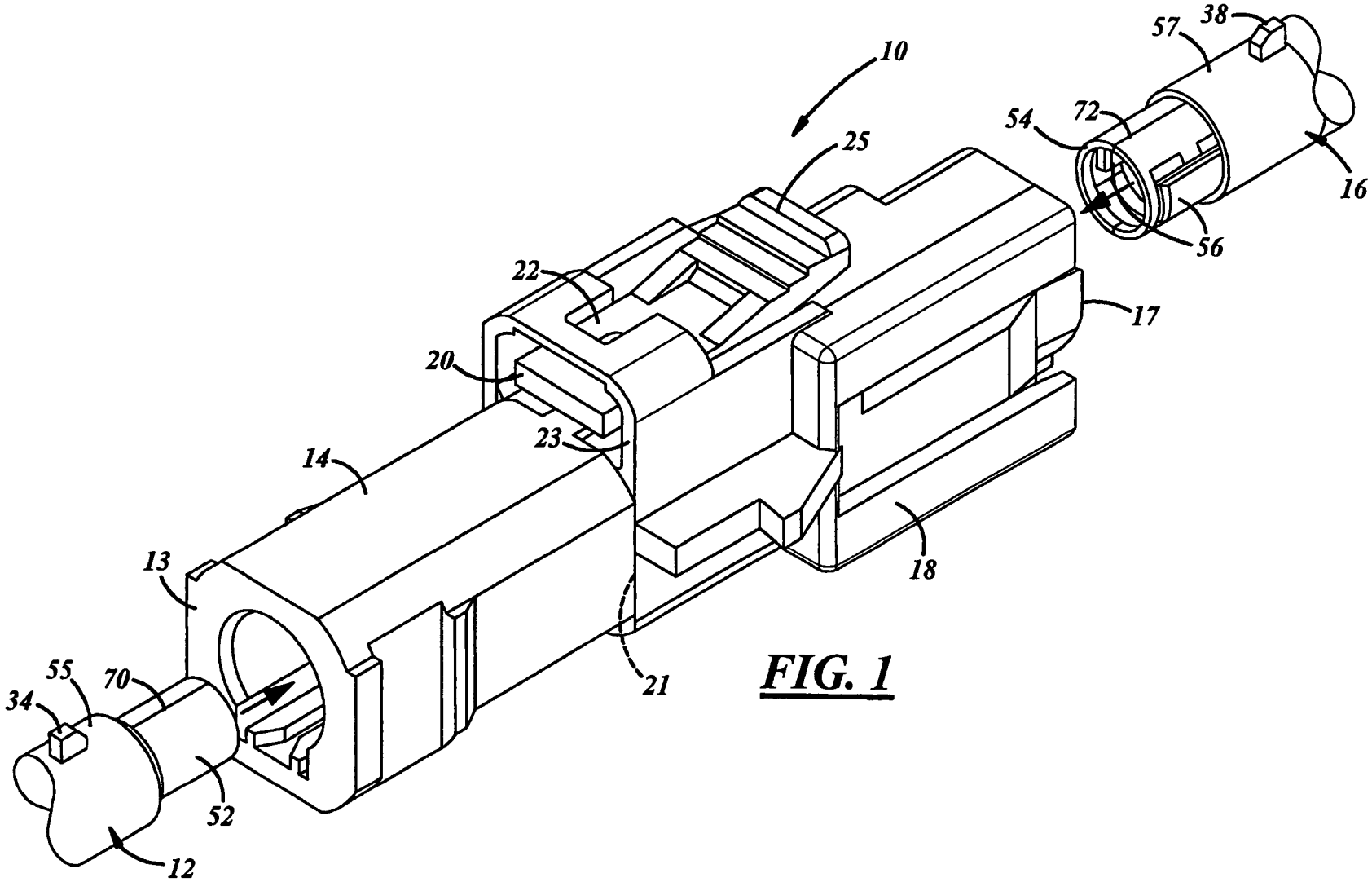
FIG. 1 is a perspective partially exploded view of a RF coax terminals and connector housing assembly.

Referring now to FIG. 1, an RF connection 10 has a male terminal assembly 12 connected through one end 13 of a male plastic housing 14. A female terminal assembly 16 is connected through one end 17 of a female plastic housing 18. The male and female plastic housings 14 and 18 are constructed to releasable snap fit together at their respective second ends 21 and 23 with a tab 20, release latch 22 and operation latch handle 25 on the respective male and female housings 14 and 18.

Figure 2:
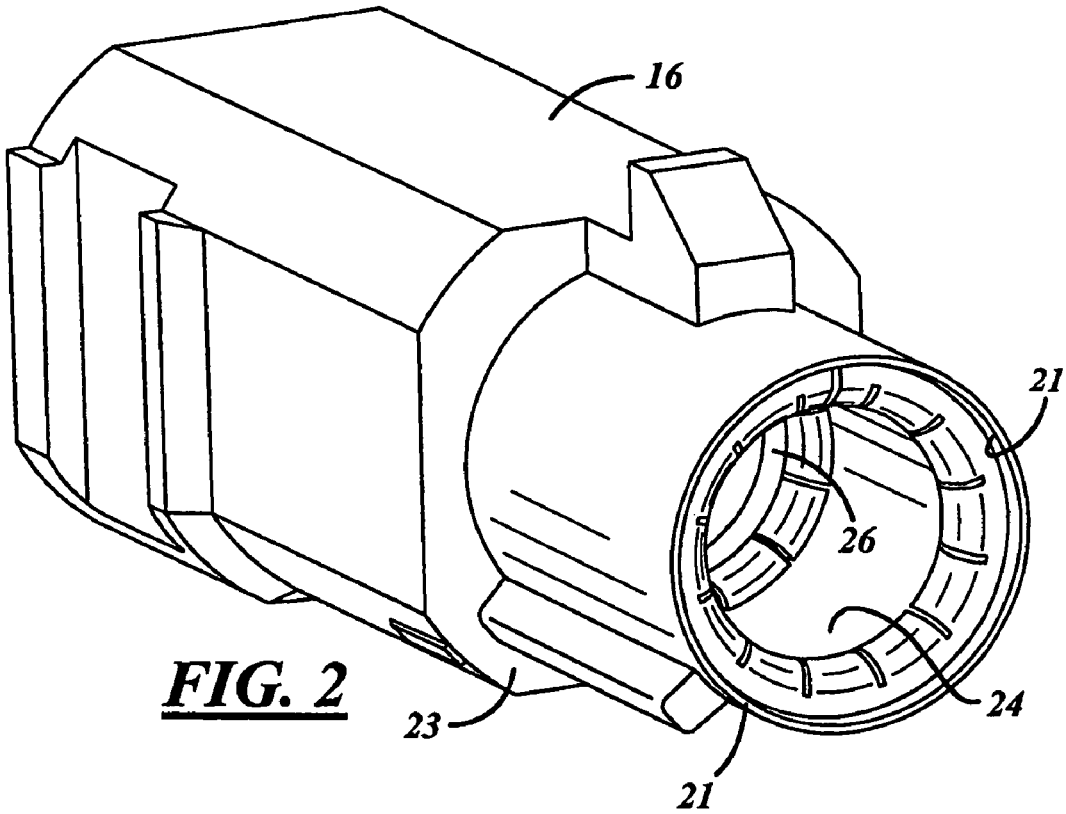
FIG. 2 is a perspective end view of a first housing member with the tubular shield installed therein.

As more clearly shown in FIG. 2, the male plastic housing 14 has a tubular shield member 24 installed at its second end 21. The second end has a round cylindrical cavity 26 which snugly receives the tubular shield 24 by a press fit. Furthermore, the end 21 of cavity 26 may be necked down and the shield 24 may be radially compress to fit through the necked down end 21 and resiliently flex back to a larger diameter abutting against the cavity 26 after it clears the necked down end 21.

Figure 3:
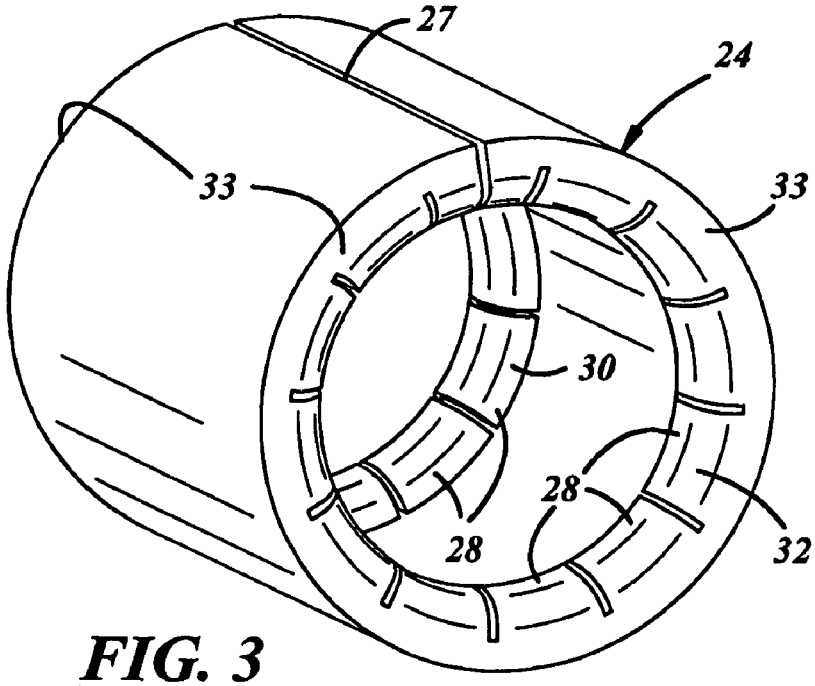
FIG. 3 is a perspective view of the tubular shield.

As more clearly shown in FIG. 3, the shield 24 is tubular with a seam 27 extending along it longitudinal axis. A first and second set 30 and 32 of resilient radially inwardly extending fingers 28 are at opposite ends 33 of the tubular shield 24. The tubular shield is made from steel or other electrically conductive and RF shielding material, for example another metal which may be electrocoated. The shield can be made by stamping a sheet of material to form the flat fingers, curling the fingers over and then forming the tubular shape of the shield such that the fingers extend radially inwardly. The fingers 28 have an arcuate shape to obtain a degree of resilient flexibility when engaging a tubular terminal therein.

Figure 4:
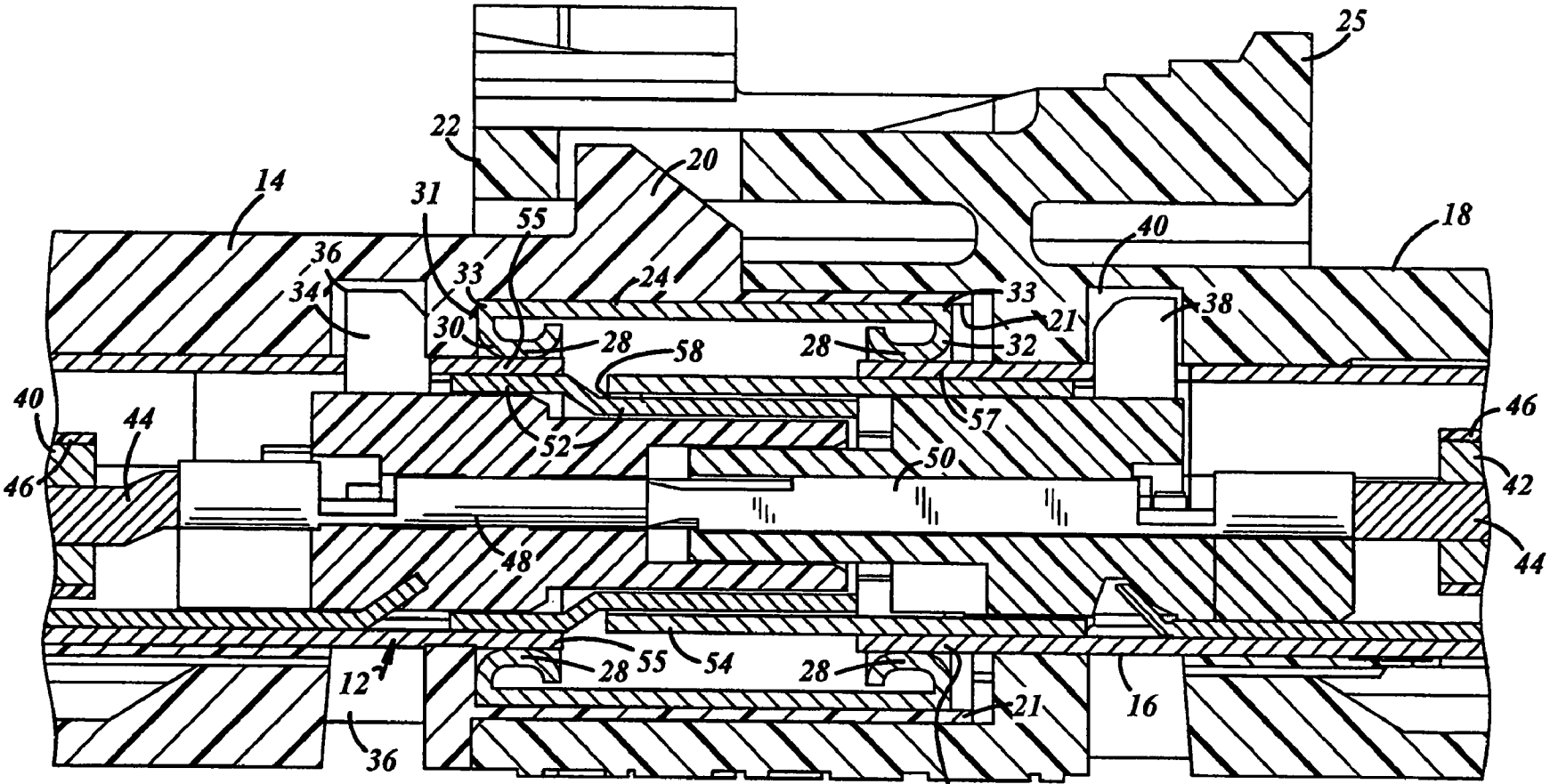
FIG. 4 is a cross-sectional view of a fully assembled RF coax terminals and housing members.

Referring now to FIG. 4, when the RF connection is fully assembled, two coax cables 40 and 42 with their respective coax center core 44 and outer coax shielding 46 are connected and the center pin 48 engages to the center inner conductor 50. In addition, the male outer terminal 52 of assembly 12 connects to the outer female terminal 54 of assembly 16 via contact arms 56 located on the female terminal 54. A ferrule 55 is conventionally crimped about terminal 52 and has a locking tab 34 engaging a circular slot 36 within the male housing 14 to retain the terminal assembly 12 to the housing 14 but allows relative rotation of the housing 14 with respect to terminal assembly 12. The shield 24 is retained in the housing 14 while terminal 12 is installed due to both the low contact force with terminal 12 and the tight press fit past the necked down end 21. A similar ferrule 57 is conventionally crimped about the female terminal 54 that likewise extends through end 17 of the female housing 18 and has a similar tab 38 engage a circular slot 40 to retain the terminal assembly 16 to the housing 18 but allow relative rotation of the housing 18 with respect to terminal assembly 16. The ferrules 55 and 57 are also conventionally crimped (not shown) about the outer coax shielding 46.

The male ferrule 55 extends through the end 13 and engages the first set 30 of resiliently radially inwardly extending fingers 28. The fingers are resiliently pressed outwardly with a low amount of contact force. The housings 14, 18 are then connected together through tab and latch mechanism 20, 22. The two terminal assemblies 12 and 16 engage each other. Terminal assemblies 12 and 16 are also rotatable with respect to each other. The terminal 57 also engages the shield 24 and shield 24 and connects to the second set 32 of fingers 28. The fingers 28 of the second set likewise resiliently flex outwardly to provide a low contact force. The shoulder 31 in housing 14 retains the shield 24 in place while terminal assembly 12 is installed. When installed, the tubular shield 24 spans the entire connection of the two terminals 52 and 54.

In this fashion, any RF leakage through the male-female gap 58 is further reduced and shielded by the tubular shield 24. This reduction takes place at any relative angle of the seams 70 and 72 in the two ferrules 52 and 54.

When the two housings 14 and 18 are disconnected from each other, the two terminal assemblies 12 and 16 also become disconnected. The shield 29 is retained in housing 14 against the pull force of terminal because of the low contact force of contact fingers 28 and the tight press fit of the shield in housing 14 along with the locking interference of necked down end 21.

Figure 5:
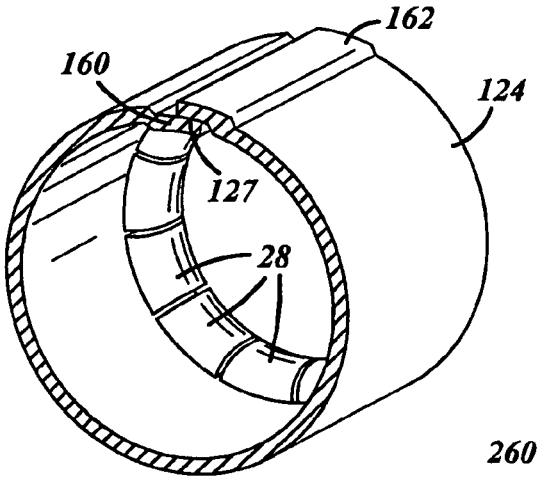
FIG. 5 is a perspective and segmented view of a second embodiment of the tubular shield.

A modified tubular shield 124 is shown in FIG. 5 where the seam 127 is also enclosed by overlapping inner and outer tabs 160 and 162. This overlapping tab construction further reduces RF leakage.

Figure 6:
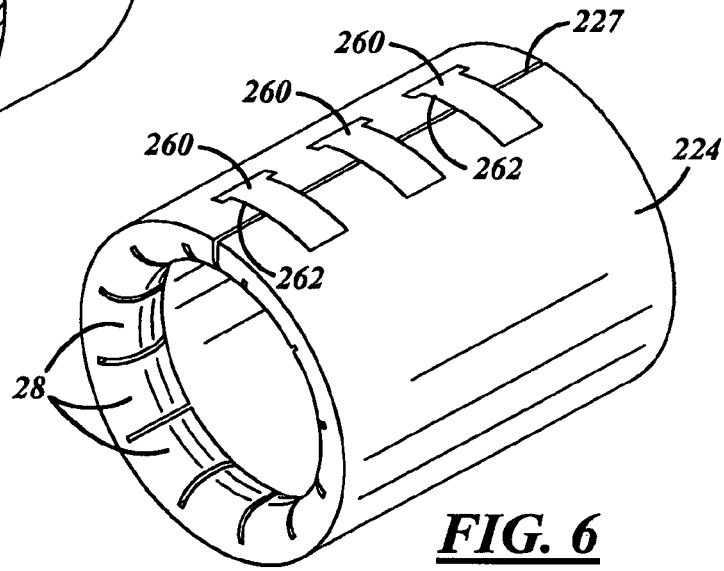
FIG. 6 is a perspective view of a third embodiment of the tubular shield.

A third embodiment of a tubular shield 224 is shown in FIG. 6 which shows locking tabs 260 spanning seam 227 and engaging interlocking notches 262 to further secure the seam 227 into a closed position. These locking tabs also further reduce RF leakage.

Figure 7:
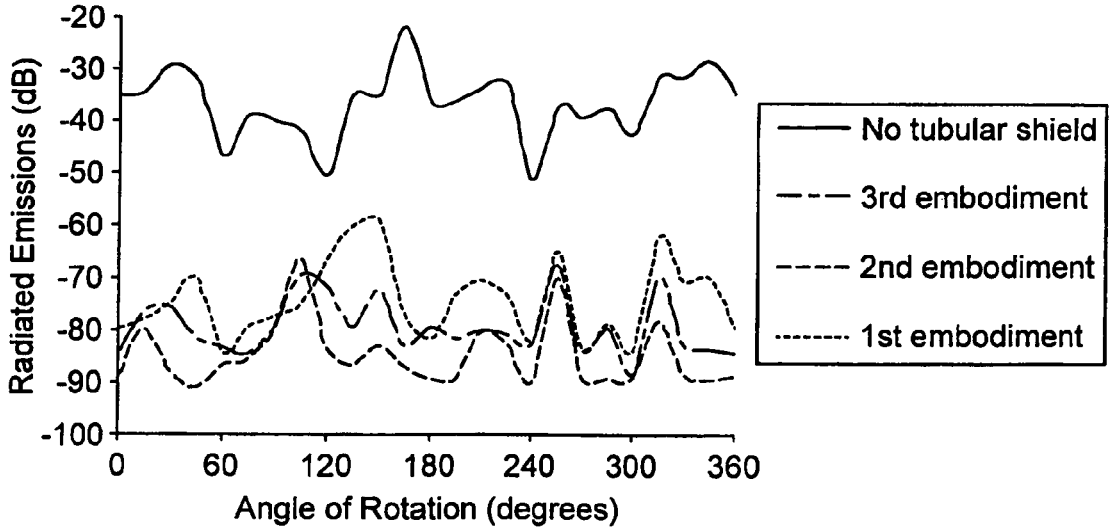
FIG. 7 is a graph illustrating radiated emissions verses the angle of rotation of the female terminal with respect to the male terminal operating at a power of 1 W at 3 GHz and measured from a distance of 1 meter.

A graph shown in FIG. 7 illustrates the effectiveness of the shielding for all three embodiments compared to a similarly constructed RF Fakra connector without the use of the tubular shield. At a power of 1 watt operating at 3 GHz, measurements were taken at 1 meter away from the assembled housing. The graph illustrates significant reduction in dB is obtained from a range of −20 dB to −50 dB for a terminal connection with no tubular shield to a more effective range of −60 dB to −90 dB when operating at 3 GHz for any three embodiments at all relative rotational angles of the two terminals 12 and 16.

It will be readily understood by those persons skilled in the art that the present invention is susceptible of broad utility and application. Many embodiments and adaptations of the present invention other than those described above, as well as many variations, modifications and equivalent arrangements, will will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

What is claimed:

1. An RF connector assembly comprising:

a first connector housing with a first end constructed for connectably receiving a terminal assembly end of a first coaxial cable;

a second connector housing with a first end constructed for connectably receiving a complementary terminal assembly end of a second coaxial cable;

wherein said terminal assembly end and said complementary terminal assembly end are complementarily constructed for engagement to each other;

said first and second connector housings being constructed at their respective second ends to connect to one another;

said first connector housing receiving a conductive tubular shield configured to radially surround and electrically connect to said terminal assembly end of said first coaxial cable; and said tubular shield having a set of resilient radially inwardly extending contact fingers for radially surrounding and electrically connecting to said complementary terminal assembly end of said second coaxial cable when said second connector housing is connected to said first connector housing;

wherein said tubular shield has a second set of resiliently radially inwardly extending contact fingers for radially surrounding and electrically connecting to said terminal assembly end in said first connector housing; and wherein the respective first and second set of contact fingers extend inwardly from a respective end of said shield and each contact finger in the respective first and second set of contact fingers has an arcuate shape, and said tubular shield has an axially extending seam.

2. The RF connector assembly as defined in claim 1, wherein said respective first and second set of resiliently radially inwardly extending contact fingers are axially spaced from each other in proximity to opposite ends of said tubular shield.

3. The RF connector assembly defined in claim 1, wherein said seam provides overlapping tabs extending along an axial length of said tubular shield to prevent said seam from opening up.

4. The RF connector assembly defined in claim 1, wherein said seam provides complementary interlocking tabs and notches extending along an axial length of said tubular shield to prevent said seam from opening up.

5. The RF connector assembly defined in claim 2, wherein an outer terminal portion of the terminal assembly end is in electrical connection with an outer coaxial shield on the first coaxial cable and in electrical connection with the second set of contact fingers of the tubular shield when the terminal assembly end is received in the tubular shield, and an outer terminal portion of the complementary terminal assembly end is in electrical connection with an outer coaxial shield on the second coaxial cable and in electrical connection with the set of contact fingers of the tubular shield when the complementary terminal assembly end is received in the tubular shield, and a coax center core of the respective first and second coaxial cable is configured to be engagingly electrically connected to form a center inner conductor inside the tubular shield when the respective terminal and complementary terminal end are received in the tubular shield.

* * * * *